US008468966B2

(12) United States Patent
Van Den Ende et al.

(10) Patent No.: US 8,468,966 B2
(45) Date of Patent: Jun. 25, 2013

(54) ANCHOR WITH MEASUREMENT COUPLING

(75) Inventors: David Peter Van Den Ende, LB Capelle aan den IJssel (NL); Roderick Michael Ruinen, LB Capelle aan den IJssel (NL)

(73) Assignee: Stevlos B.V., Capelle Aan Den Ijssel (NL)

( * ) Notice: Subject to any disclaimer, the term of this patent is extended or adjusted under 35 U.S.C. 154(b) by 187 days.

(21) Appl. No.: 13/123,328

(22) PCT Filed: Aug. 25, 2009

(86) PCT No.: PCT/NL2009/050510

§ 371 (c)(1),
(2), (4) Date: Jun. 30, 2011

(87) PCT Pub. No.: WO2010/041929

PCT Pub. Date: Apr. 15, 2010

(65) Prior Publication Data

US 2011/0247543 A1 Oct. 13, 2011

(30) Foreign Application Priority Data

Oct. 10, 2008 (NL) ..... 2002086

(51) Int. Cl.
*B63B 21/32* (2006.01)

(52) U.S. Cl.
USPC ..... 114/301; 114/294

(58) Field of Classification Search
USPC ..... 114/294, 301, 304
See application file for complete search history.

(56) References Cited

U.S. PATENT DOCUMENTS

| | | | | |
|---|---|---|---|---|
| 3,946,695 | A | 3/1976 | Isaak | |
| 4,706,595 | A * | 11/1987 | van den Haak | 114/301 |
| 5,970,901 | A * | 10/1999 | Bruce | 114/293 |
| 6,041,730 | A | 3/2000 | Oliverio et al. | |

FOREIGN PATENT DOCUMENTS

| | | |
|---|---|---|
| GB | 2 196 918 A | 5/1988 |
| WO | 2008/045788 A | 4/2008 |

* cited by examiner

*Primary Examiner* — Lars A Olson
(74) *Attorney, Agent, or Firm* — Ladas & Parry LLP

(57) ABSTRACT

Anchor comprising a fluke which can be introduced into an anchoring ground in accordance with a direction of penetration by exerting a pulling force on an anchor line connected to the anchor, and a measuring coupling which during introduction of the fluke forms part of a force transfer between the anchor line and the fluke, wherein the measuring coupling is provided with a first coupling member that is connected to the fluke, a second coupling member that is connected to the anchor line, a hollow coupling bar that couples the coupling members to one another, wherein the coupling members in the longitudinal direction of the bar engage onto the coupling bar at different places in order to be able to deform it, and a measuring body extending through the hollow coupling bar and which at least at its ends is connected to the coupling bar in order to deform along with the coupling bar, wherein the measuring body is provided with deformation sensors for recording the deformation parameters of the coupling bar.

20 Claims, 6 Drawing Sheets

ANCHOR WITH MEASUREMENT COUPLING

BACKGROUND OF THE INVENTION

The invention relates to an anchor, particularly for anchoring heavy maritime objects, such as a drilling platform, into an anchoring ground for a long period of use that may last many years.

Such anchors at an anchoring line are placed onto the anchoring ground from an installation ship, after which the installation ship pulls at the anchor line to bring the anchor into the anchoring ground. During pulling the pulling force on the anchor line is measured from the installation ship. The pulling force and the pulling path of the installation ship then form a parameter for the penetration path of the anchor and the expected holding force the anchor will be able to provide.

Owners of heavy maritime objects make high demands on the degree of reliability of the expected holding force. Therefore it has to be ruled out that a considerable component of the pulling force measured on the installation ship is for instance caused by obstacles that have engaged onto the anchor line during the insertion of the anchor.

It is an object of the invention to provide an anchor with which the penetration path of the anchor and the expected holding force can be established to an acceptable degree.

SUMMARY OF THE INVENTION

The invention provides an anchor comprising a fluke which can be introduced into an anchoring ground in accordance with a direction of penetration by exerting a pulling force on an anchor line connected to the anchor, and a measuring coupling which during introduction of the fluke forms part of a force transfer between the anchor line and the fluke, wherein the measuring coupling is provided with a first coupling member that is connected to the fluke, a second coupling member that is connected to the anchor line, a hollow coupling bar that couples the coupling members to one another, wherein the coupling members in the longitudinal direction of the bar engage onto the coupling bar at different places in order to be able to deform it, and a measuring body extending through the hollow coupling bar and which at least at its ends is connected to the coupling bar in order to deform along with the coupling bar, wherein the measuring body is provided with deformation sensors for recording deformation parameters of the measuring body.

The coupling bar deforms, particularly bends, depending on the forces exerted on the coupling bar by the first and second coupling member. Said deformation is applied onto the measuring body, which deformation is recorded by the deformation sensors. Therefore the deformation recorded by the deformation sensors is a parameter for the action of forces between the first and second coupling member as performed at the anchor side of the anchor line, that means independent of forces that may act on the anchor line by obstacles. In that way the expected holding force of the anchor can be predicted with a high degree of reliability. The relation between the action of forces and the deformations can be determined on the basis of interpolation of test data obtained earlier, or be calculated according to the rules of mechanics, for instance by means of a finite element analysis.

In one embodiment the measuring body is fixedly connected to the coupling bar, as a result of which deformations of the coupling bar can be imposed directly and proportionally onto the measuring body.

In one embodiment the measuring body extends freely through the coupling bar between the ends connected to the coupling bar, as a result of which the measuring body can easily be inserted in the cavity in the coupling bar.

The cavity in the coupling bar may be defined by a straight bore through the coupling bar. In a freely extending embodiment the measuring body may be narrower over its length between the ends than it is at its ends.

In one embodiment the measuring body comprises at least one elongated strip or plate. Due to its shape a strip or plate is suitable for mechanical calculations.

In one embodiment the measuring body comprises at least two elongated strips or plates which over their length are positioned substantially transverse to each other. The position transverse to each other offers the possibility to analyse the deformations according to a Cartesian coordinate system.

In a simple embodiment the strips are fixedly connected to one another.

In one embodiment the strips in cross-section form a cross. The deformation sensors can then be provided on all legs of the cross for an exact determination of the deformation of the coupling bar.

In one embodiment the measuring body is made of metal, preferably steel.

In one embodiment the deformation sensors are grouped in at least one straight series extending substantially transverse to the longitudinal direction of the measuring body. The deformation of the measuring body can then be recorded over a large part of its width including deformation differences over the length of the series, which renders an accurate determination of the deformation of the measuring body in its entirety and thus the coupling bar possible.

In one embodiment thereof the deformation sensors are grouped in several straight series distributed over the measuring body in the longitudinal direction of the measuring body, so that the deformation at several locations distributed over the length over a large part of the width of the measuring body can be recorded.

In one embodiment the measuring coupling comprises two first coupling members that spaced apart from each other, engage onto the coupling bar. The first coupling members connected to the fluke are able to load the sampling bar to bend in cooperation with the second coupling member, as a result of which the bending and its specific bending shape is a parameter for the force the anchor line exerts on the fluke, and for the direction of said force. Likewise the measuring coupling may comprise two second coupling members that spaced apart from each other, engage onto the coupling bar.

In one embodiment the two first coupling members or the two second coupling members within the measuring coupling form the outermost engagement onto the coupling bar. In between them the other or other coupling members can engage to load the coupling bar to bend.

In one embodiment the anchor comprises a shank that is fixedly connected to the fluke, wherein the first coupling member forms a part of the shank, wherein the first coupling member preferably is situated at the end of the shank that faces away from the fluke.

In one embodiment thereof the coupling bar, regarding its rotation, is fixedly connected to the shank, as a result of which the direction of a force exerted on the coupling bar by the second coupling member can be related to the shank and the fluke.

In one embodiment the second coupling member forms the end of an anchor line coupling connected to the anchor line. The anchor line coupling may for instance be a bow shackle that can be swung about the coupling bar.

The direction of penetration and thus the penetration forces will be substantially parallel to the longitudinal plane of symmetry of the anchor. In one embodiment the coupling bar in its longitudinal direction therefore extends transverse to the longitudinal plane of symmetry of the anchor, as a result of which the coupling bar extending transverse to the longitudinal plane of symmetry can be properly loaded to bend in order to determine the action of forces.

In one embodiment the measuring coupling is furthermore provided with an inclinometer that is accommodated in the coupling bar, so that in addition to the action of forces on the coupling bar also tiltings of the coupling bar with respect to a notional place can be determined, which is a parameter for the pitch and roll of the anchor.

In one embodiment the measuring coupling is provided with an accelerometer that is accommodated in the coupling bar, so that by means of integration of the momentary acceleration in time the path of the coupling bar can be determined, which is a parameter for the penetration path of the anchor in the anchoring ground.

In one embodiment the measuring coupling is provided with a pressure sensor for recording the water pressure at the location of the measuring coupling. The water pressure is a parameter for the depth of the anchor with respect to the water line, from which the depth in the anchoring ground can be derived. In combination with for instance the pitch the horizontal component of the anchoring path may also be derived from the depth.

The data of the said measuring equipment can be processed and interpreted remote from the anchor, for instance from an installation ship, when the measuring coupling comprises an electronic circuit that is coupled to the deformation sensors, and preferably to the inclinometer and/or accelerometer and/or the pressure sensor, wherein the electronic circuit is adapted for processing and transmitting measurement data therefrom to a remote calculation and processing unit.

The inclinometer, the accelerometer and/or the electronic circuit may be placed in the hollow coupling bar as one prefab unit with the measuring body and be attached there when they are fixedly connected to the measuring body.

The aspects and measures described in this description and the claims of the application and/or shown in the drawings of this application may where possible also be used individually. Said individual aspects may be the subject of divisional patent applications relating thereto. This particularly applies to the measures and aspects that are described per se in the sub claims.

SHORT DESCRIPTION OF THE DRAWINGS

The invention will be elucidated on the basis of a number of exemplary embodiments shown in the attached drawings, in which.

DETAILED DESCRIPTION OF THE DRAWINGS

Figure 1:
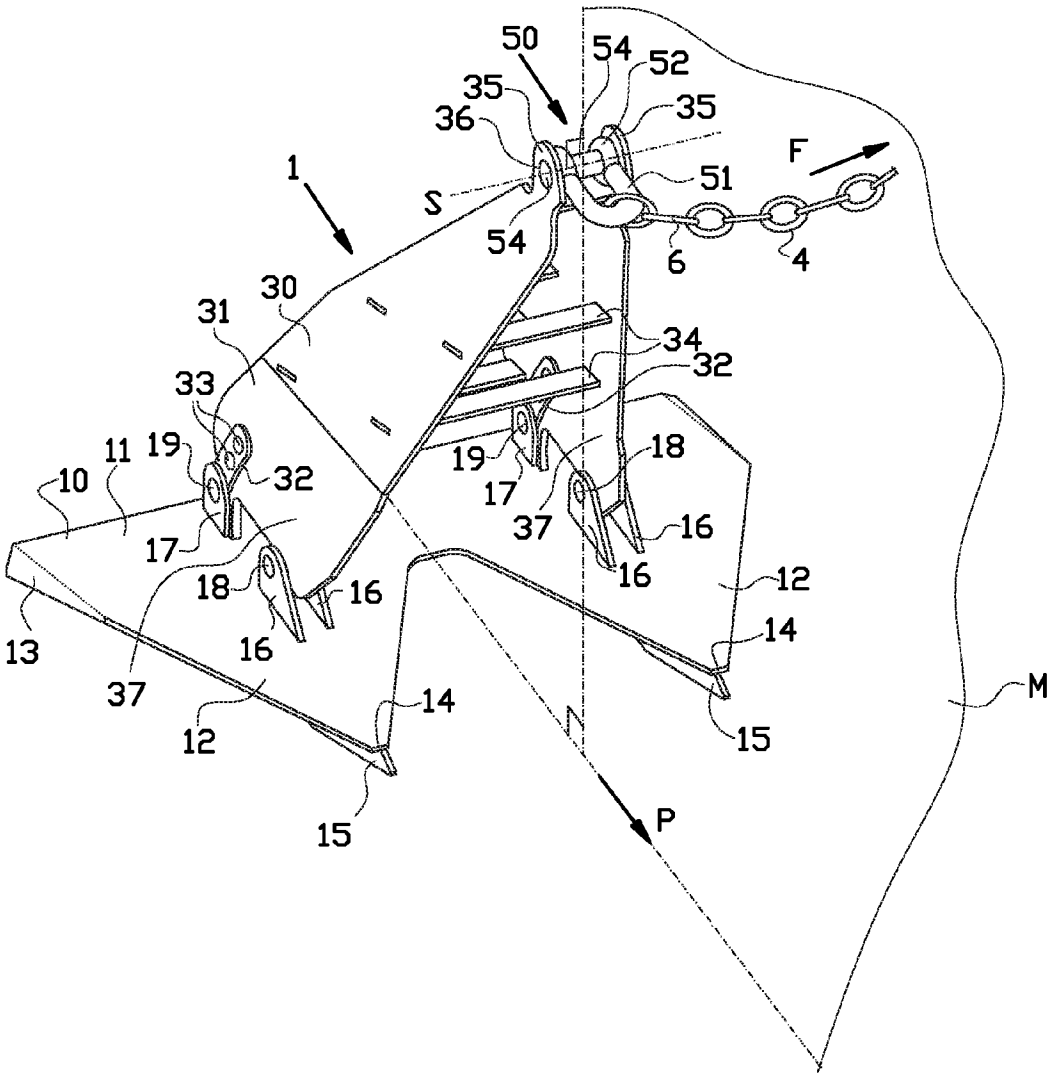
FIG. 1 shows an isometric front view of an anchor according to the invention, connected to an anchor line by means of a measuring coupling.
Figure 2:
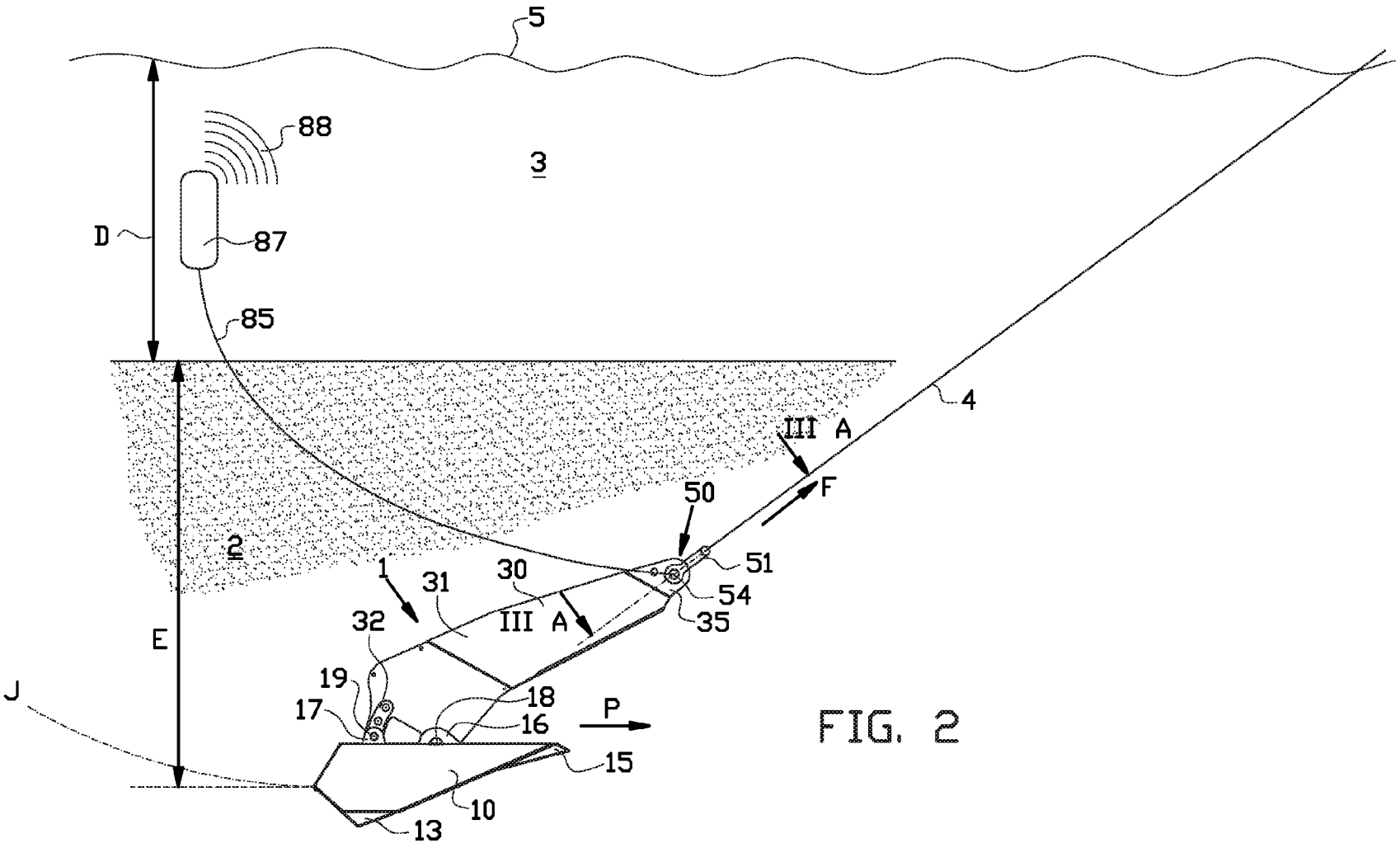
FIG. 2 shows a side view of the anchor according to FIG. 1, introduced into an anchoring ground.

FIGS. 1 and 2 show a steel anchor 1 according to an embodiment of the invention. The anchor 1 is intended for anchoring heavy maritime objects, such as a drilling platform that is not further shown, in an anchoring ground 2, for a long period of use that may last many years. The anchor 1 comprises a fluke 10 and a shank 30 which with respect to the fluke 10 inclines obliquely forward and which at its end is provided with a measuring coupling 50 with which the anchor 1 is connected to an anchor line 4. The anchor 1 is substantially symmetrical with respect to its longitudinal plane of symmetry M. The anchor 1 is formed for in a forward direction of penetration P being introduced into the anchoring ground 2 substantially parallel to the longitudinal plane of symmetry M.

The fluke 10 is built up using plate members, and at its rear side comprises a base plate 11 over its width, which base plate on both sides of the centre longitudinal plane M merges into two triangular front Ands 12. On both sides of the base 11 two downwardly oriented side plates 13 are provided which extend parallel to each other, and below the front ends 12 two parallel longitudinal girders 15 extend from the tips 14. At the upper side the fluke 10 is provided with upright securing lips 16, 17 having securing pins 18, 19 for the shank 30.

The shank 30 is built up with two plate-shaped shank legs 31 which in upward direction taper obliquely towards each other. The shank legs 31 are connected to each other along their length by means of transverse plates 34. At their lower side, the shank legs 31 have a bent portion 37 which is accommodated between the securing lips 16, 17, wherein the securing pins 18, 19 extend through fixing holes that are not shown in the bent portions 37. At the rear side the fixing holes are formed in a reinforced part 32 on the bent portion 37, which reinforced part 32 is provided with a series of extra holes 33 for adjusting the angle between the fluke 10 and the shank 30. At the upper end, the shank legs 31 are provided with end ears 35 extending parallel to each other and having fixing holes 36 for a measuring coupling 50 to the anchor line 4.

The measuring coupling 50 is also shown in detail in FIGS. 3A-3D, and comprises a straight, cylindrical steel connecting pen 54 which extends through the fixing holes 36 of the end ears 35. The centre line S of the connecting pen 54 is oriented substantially perpendicular to the longitudinal plane of symmetry M. Between the end ears 35 the connecting pen 54 also extends through the eyes 52 of a bow shackle coupled to the anchor line 4. The connecting pen 54 is accommodated under positive tolerances in the fixing holes 36 and the eyes 52, wherein an indexation that is not further shown is provided and which counteracts rotation of the connecting pen 54 about its centre line S with respect to the shank 30. The bow shackle 51 is able to swing about the connecting pen 54 in the longitudinal plane of symmetry M.

The connecting pen 54 is provided with a cylindrical bore or inner space 55 which at the ends is closed off with end caps 56 which are welded together all round by means of a weld 57, as a result of which the inner space 55 is closed off watertight. In the inner space 55 an elongated measuring body 60 is confined.

The measuring body 60 comprises an elongated vertical steel plate 61 and a horizontal elongated steel plate 62 having a substantially constant thickness. The steel plates 61, 62 are identical in this example. The plates 61, 62 are both provided with two straight head end edges 65 which via four straight longitudinal end edges 63 merge into two straight longitudinal side edges 64 that are receded therefrom and which form a narrowing of the respective plate 61, 62 with respect to the longitudinal end edges 63. The plates 61, 62 are both provided with a centre slot 66 which from one of the head end edges 65 extends over half the length of the respective plate 61, 62 after which the plates 61, 62 have been inserted in each others centre slot 66 and welded together over the full length. The measuring body 60 therefore has a shape-retaining prismatic shape wherein the cross-section over the length is perpendicularly cross-shaped. Due to the said longitudinal weld the ribs of the cross are rigidly connected to each other.

The head end edges 65 and the longitudinal end edges 63 of the measuring body 60 abut the boundary wall 58 of the inner space 55 and the inner surface 59 of the end caps 56, respectively, wherein between the longitudinal end edges 63 and the boundary wall 58 a weld has been made in order to fixedly connect it to the connecting pen 54. As a result an elastic deformation of the connecting pen 54 at the ends is applied on the measuring body 60 whereas it remains free from the boundary wall 58 over the narrowing defined by the longitudinal side edges 64.

Figure 3B:
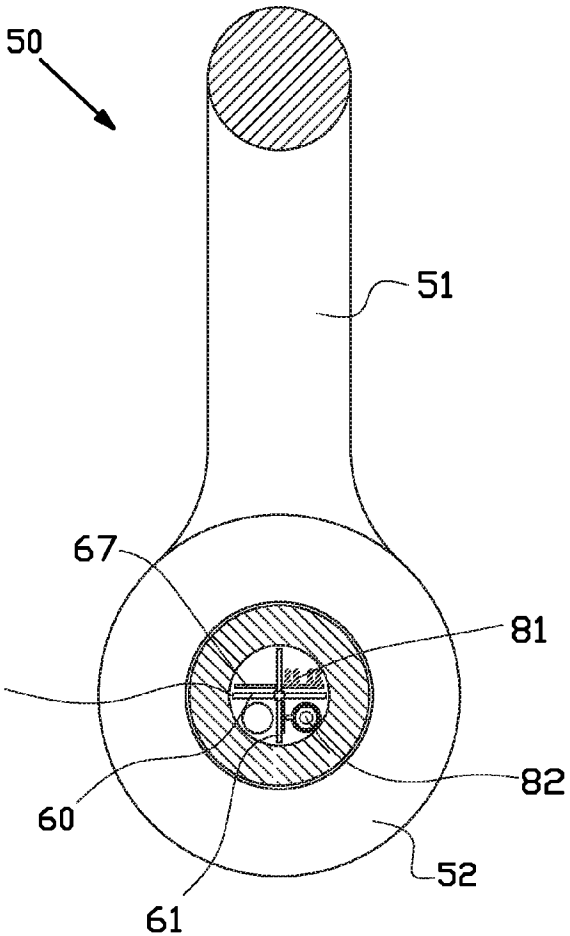
FIGS. 3A-3D shows a longitudinal section, a cross-section and details of the measuring coupling according to FIGS. 1 and 2.
Figure 3A:
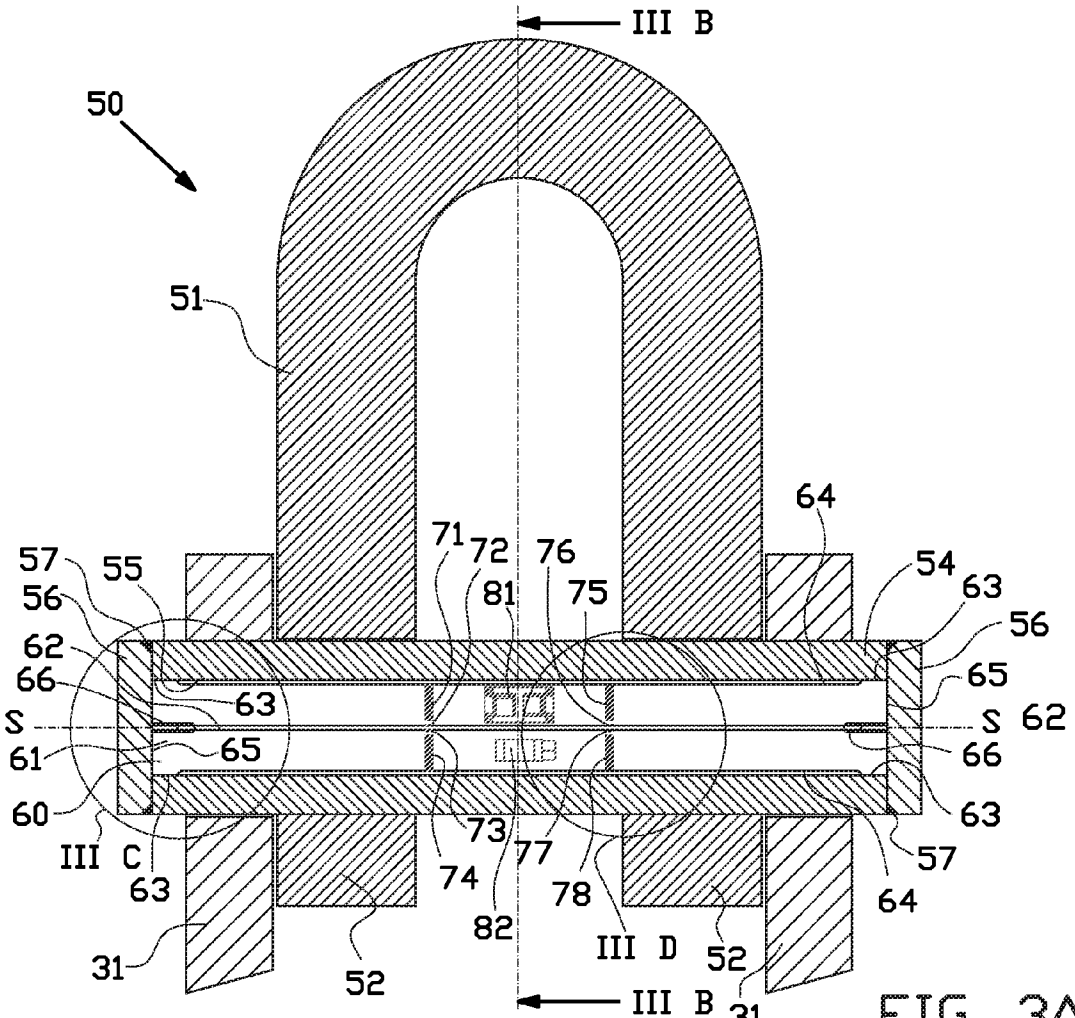
Figure 3C:
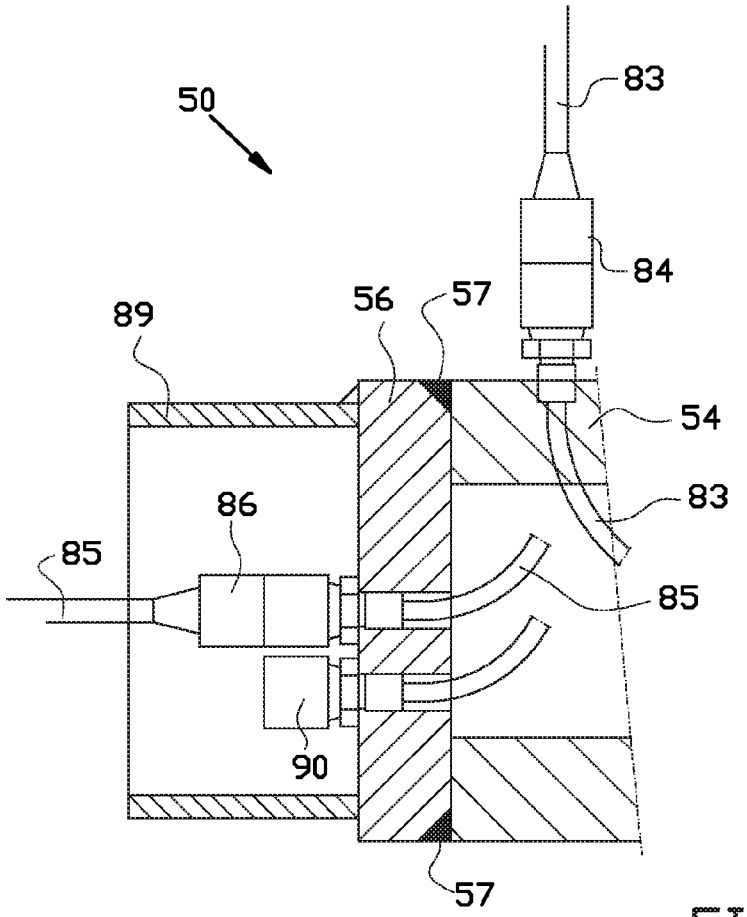
Figure 3D:
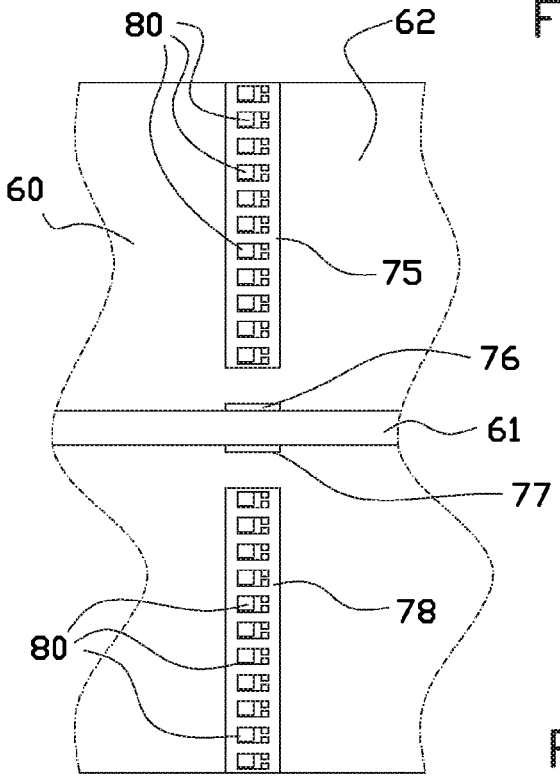
Figure 4A:
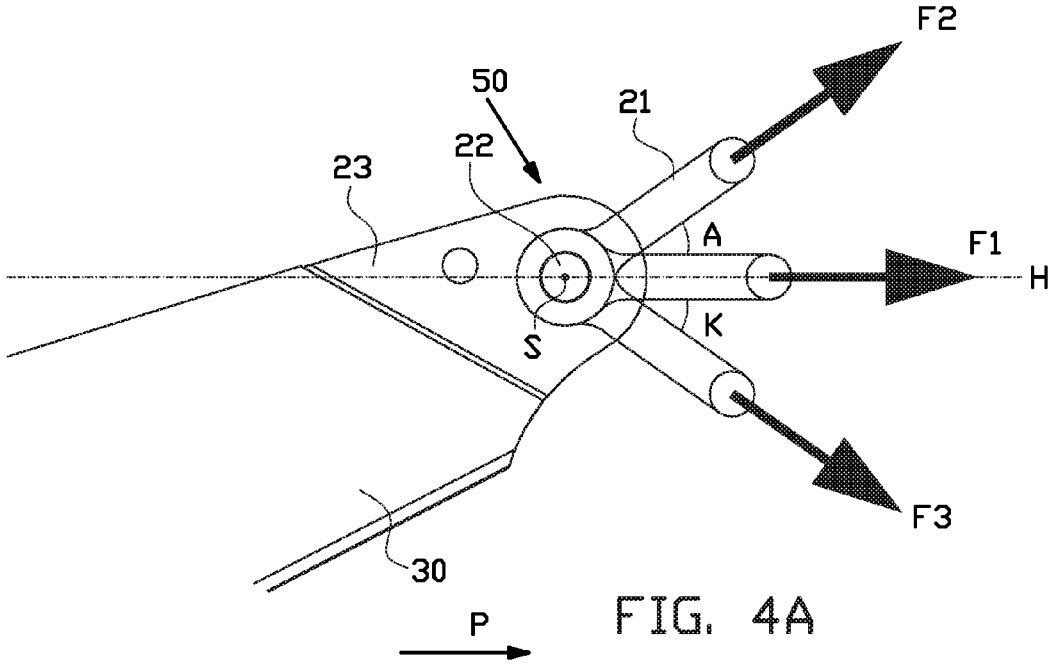
FIGS. 4A-4C show examples of the action of forces on the measuring coupling according to the preceding figures, during the introduction of the anchor in the anchoring ground.
Figure 4B:
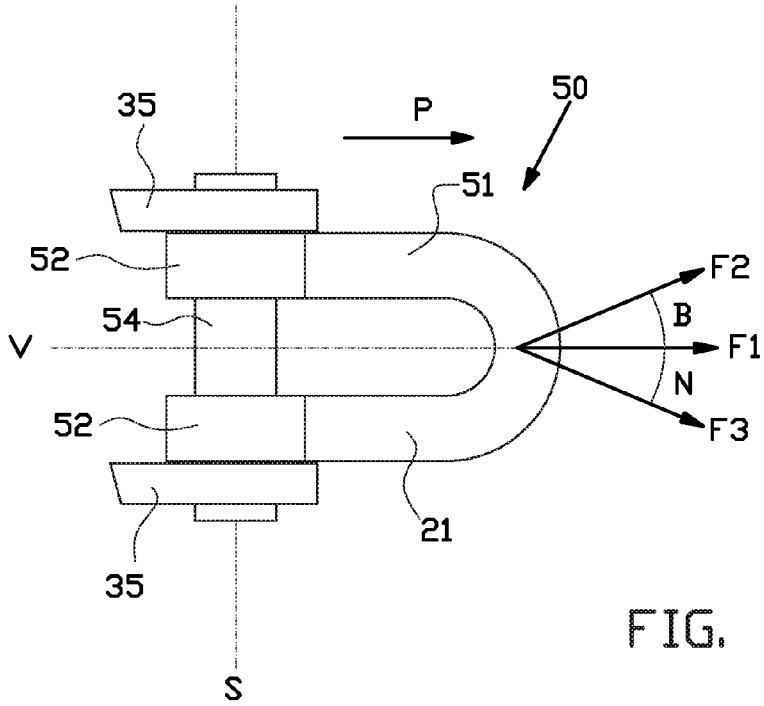
Figure 4C:
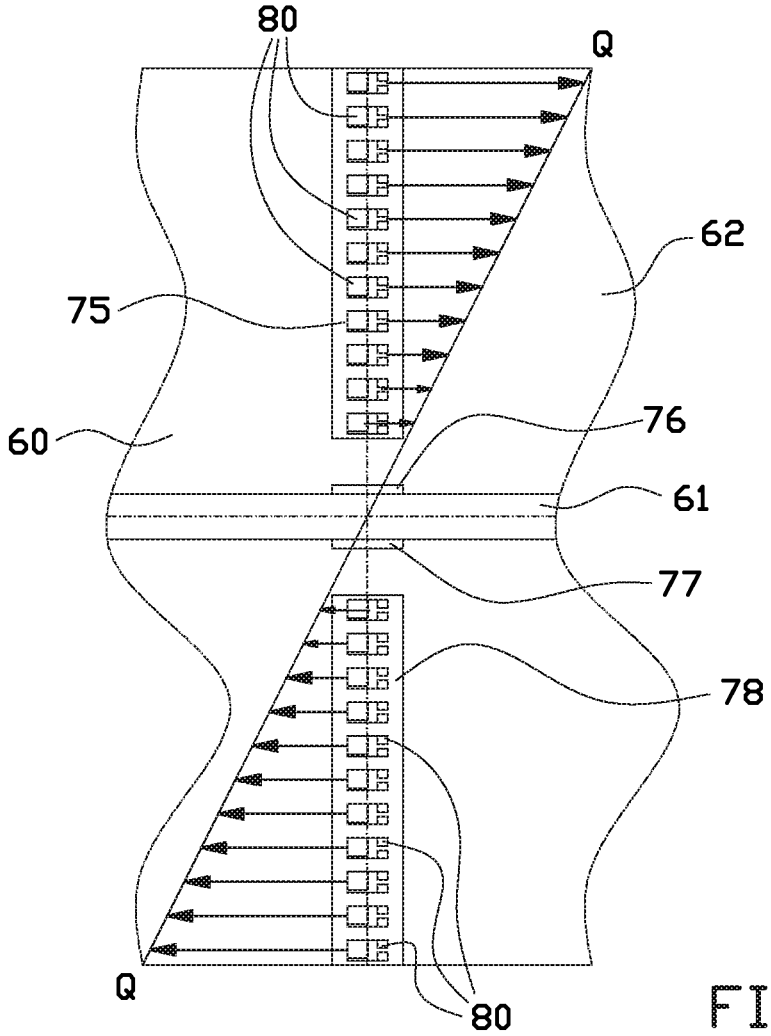

As shown in FIGS. 3A and 4C on both sides of the centre parting and on both sides of the longitudinal plane of symmetry M, both plates 61, 62 of the measuring body 60 are provided with in this example a total of eight carrier strips 71-78 extending transverse to the centre line S. Each carrier strip 71-78 is provided with a series of in this example twelve electric strain gauges 80. The measuring body 60 is provided with a carrier plate 67 that is connected to the vertical steel plate 61. The carrier plate 67 carries a printed circuit-board 81 having an electronic circuit that is electrically connected to each of the strain gauges 80.

The vertical plate 62 has also been provided with a unit 82 having electronic inclinometers and accelerometers that are electrically connected to the printed circuit-board 81. The printed circuit-board 81 is furthermore connected to a partially external pressure sensor 90 for measuring the water pressure. The printed circuit-board 81 is furthermore connected to a power cable 83 which by means of a pull relief 84 is inserted in the connecting pen 54 and which is connected to a battery housing that is not further shown on the shank 30. The printed circuit-board 81 is furthermore connected to a communication cable 85 which by means of a pull relief 86 is inserted into the end cap 56 and which is connected to an acoustic modem 87 that is known per se for acoustic transfer 88 of data under water. Said pull relief 86 is shielded by means of a case 89 that has been welded thereon. The electronic circuit on the printed circuit-board 81 is adapted for receiving, processing and transmitting electronic signals from the strain gauges 80, the inclinometers, the accelerometers and the pressure sensor 90. Due to the fixed orientation of the measuring body 60 with respect to the shank 30 the position of the anchor 1 with respect to a notional horizontal plane H and a notional vertical plane V can be determined, and thus the pitch and roll of the anchor 1. By means of the pressure sensor 90 the height of the water column above the connecting pen 54 and thus the depth of the anchor 1 with respect to the water line can be determined.

FIG. 2 shows the anchor 1 during introduction in a submarine 3 anchoring ground 2, such as a seabed, from an installation ship located on the water line 5 and which is not further shown. The installation ship is provided with an acoustic modem that is not further shown for communication with the modem 87 at the anchor 1, which modem is coupled to a calculation and data processing unit. In a preceding step the anchor 1 has been placed from the installation ship on the anchoring ground 2 at depth D, with the tips 14 of the fluke 10 in the direction of the installation ship. The acoustic modem 87 and the communication cable 85 are then still in the water 3. Subsequently the installation ship has exerted a force F on the anchor 1 via the anchor line 4, as a result of which the anchor 1 has gone through a penetration path J down to a certain depth E in the anchoring ground 2.

During going through the penetration path J the end ears 35 of the shank 30 on the one hand and the eyes 52 of the bow shackle 51 on the other hand have exerted bending forces and bending moments on the connecting pen 54, wherein the related deformations have been applied on the measuring body 60. This takes place within the elastic range of the connecting pen 54 and the measuring body 60. Subsequent thereto the strain gauges 80 have been subjected to deformations via the plates 61, 62 of the measuring body 60, for instance per plate 61, 62 according to a distribution Q such as shown with vectors in FIG. 4C. The deformations of the individual strain gauges 80 and the data of the inclinometers and the accelerometers have been registered by the electronic circuit and directly communicated to the calculation and data processing unit on the installation ship. The calculation and data processing unit is able to derive the penetration path J from these data, and the related action of forces F1-F3 between the anchor 1 and the anchor line 4, for instance by interpolation of known test data, or by a finite element analysis. The force may for instance be horizontally oriented as shown with force F1, upwardly inclined at angles A, B as shown with force F2 or downwardly inclined at angle K, N. On the basis of the magnitude and the direction of the forces F1-F3 in relation to the penetration path J it can be determined with acceptable reliability whether the anchor 1 has set properly and whether it will be able to provide the specified holding power.

In the anchor 1 described, the connecting pen 54 forms the coupling between the bow shackle 51 and the fluke 10. Alternatively the connecting pen 54 takes the place of one of the pins 18, 19 with which the shank 30 is coupled to the fluke 10.

The anchor 1 described is provided with a fluke 10 and a shank 30 that is fixedly connected thereto and which ensures the connection between the fluke 10 and the anchor line 4. Alternatively the fluke 10 may by means of the securing lips 16, 17 be connected to pulling cables which come together at the location of the measuring coupling 50.

The above description is included to illustrate the operation of preferred embodiments of the invention and not to limit the scope of the invention. Starting from above explanation many variations that fall within the spirit and scope of the present invention will be evident to an expert.

The invention claimed is:

1. Anchor (1) comprising a fluke (10) which can be introduced into an anchoring ground (2) in accordance with a direction of penetration (P) by exerting a pulling force (F) on an anchor line (4) connected to the anchor, and a measuring coupling (50) which during introduction of the fluke forms part of a force transfer between the anchor line and the fluke, wherein the measuring coupling (50) is provided with a first coupling member (31) that is connected to the fluke, a second coupling member (52) that is connected to the anchor line (4), a hollow coupling bar (54) that couples the coupling members to one another, wherein the coupling members in the longitudinal direction of the bar engage onto the coupling bar at different places in order to be able to deform it, and a measuring body (60) extending through the hollow coupling bar and which at least at its ends (63, 65) is connected to the coupling bar in order to deform along with the coupling bar, wherein the measuring body (60) is provided with deformation sensors (80) for recording deformation parameters of the measuring body.

2. Anchor (1) according to claim 1, wherein the measuring body (60) is fixedly connected to the coupling bar (54).

3. Anchor (1) according to claim 1, wherein the measuring body (60) extends freely through the coupling bar (54) between the ends connected to the coupling bar.

4. Anchor (1) according to claim 1, wherein the measuring body (60) is narrower over its length between the ends (63, 65) than it is at its ends (63, 65).

5. Anchor (1) according to claim 1, wherein the measuring body (60) comprises at least one elongated strip or plate (61, 62).

6. Anchor (1) according to claim 1, wherein the measuring body (60) comprises at least two elongated strips or plates (61, 62) which over their length are positioned substantially transverse to each other.

7. Anchor (1) according to claim 6, wherein the strips (61, 62) are fixedly connected to one another.

8. Anchor (1) according to claim 6, wherein the strips (61, 62) in cross-section form a cross.

9. Anchor (1) according to claim 1, wherein the measuring body (60) is made of metal.

10. Anchor (1) according to claim 1, wherein the deformation sensors (80) are grouped in at least one straight series extending substantially transverse to the longitudinal direction of the measuring body (60).

11. Anchor (1) according to claim 10, wherein the deformation sensors (80) are grouped in several straight series distributed over the measuring body (60) in the longitudinal direction of the measuring body.

12. Anchor (1) according to claim 1, wherein the measuring coupling (50) comprises two first coupling members (31) that spaced apart from each other, engage onto the coupling bar (54).

13. Anchor (1) according to claim 1, wherein the measuring coupling (50) comprises two second coupling members (52) that spaced apart from each other, engage onto the coupling bar (54).

14. Anchor (1) according to claim 13, wherein the two first coupling members (31) within the measuring coupling (50) form the outermost engagement onto the coupling bar (54).

15. Anchor (1) according to claim 1, comprising a shank (30) that is fixedly connected to the fluke, wherein the first coupling member (31) forms a part of the shank.

16. Anchor (1) according to claim 15, wherein the first coupling member (31) is situated at the end of the shank that faces away from the fluke (10).

17. Anchor (1) according to claim 1, wherein the second coupling member (52) forms the end of an anchor line coupling (51) connected to the anchor line (4).

18. Anchor (1) according to claim 1, wherein the coupling bar (54) in its longitudinal direction extends transverse to the longitudinal plane of symmetry (M) of the anchor.

19. Anchor (1) according to claim 1, wherein the measuring coupling (80) is provided with an inclinometer that is accommodated in the coupling bar (54).

20. Anchor (1) according to claim 19, wherein the inclinometer is fixedly connected to the measuring body (60).

* * * * *